US009579263B2

(12) United States Patent
Ababio

(10) Patent No.: US 9,579,263 B2
(45) Date of Patent: Feb. 28, 2017

(54) TIME AND TEMPERATURE SENSOR MEDICATION DISPENSER FOR HOSPITALS AND NURSING HOMES/MONTHLY PERSONAL TIME

(71) Applicant: Juliet Bragu Ababio, Wallkill, NY (US)

(72) Inventor: Juliet Bragu Ababio, Wallkill, NY (US)

( * ) Notice: Subject to any disclaimer, the term of this patent is extended or adjusted under 35 U.S.C. 154(b) by 0 days.

(21) Appl. No.: 14/257,735

(22) Filed: Apr. 21, 2014

(65) Prior Publication Data

US 2016/0081881 A1 Mar. 24, 2016

Related U.S. Application Data

(60) Provisional application No. 61/945,076, filed on Feb. 26, 2014.

(51) Int. Cl.

| | |
|---|---|
| ***G08B 1/00*** | (2006.01) |
| ***A61J 7/00*** | (2006.01) |
| ***A61J 7/04*** | (2006.01) |

(52) U.S. Cl.

CPC ..... *A61J 7/0076* (2013.01); *A61J 7/0069* (2013.01); *A61J 7/0409* (2013.01); *A61J 7/0418* (2015.05); *A61J 7/0454* (2015.05)

(58) Field of Classification Search

CPC A61J 7/0481; A61J 7/0084; A61J 7/04; A61J 7/0409; A61J 7/0076; A61J 7/0454; A61J 7/0418

USPC ... 340/540, 309.16, 5.54, 573.1, 309.7, 457, 340/539.12; 221/15, 3, 102, 203

See application file for complete search history.

(56) References Cited

U.S. PATENT DOCUMENTS

| | | | | |
|---|---|---|---|---|
| 3,278,010 A | | 10/1966 | Katz | |
| 4,126,247 A | | 11/1978 | Majka | |
| 4,419,016 A | * | 12/1983 | Zoltan | A61J 7/0481 206/534 |
| 4,768,177 A | * | 8/1988 | Kehr | A61J 7/04 221/15 |
| 5,011,032 A | * | 4/1991 | Rollman | A61J 7/04 116/321 |
| 5,088,056 A | * | 2/1992 | McIntosh | A61J 7/04 340/309.7 |
| 5,099,463 A | * | 3/1992 | Lloyd | A61J 7/0481 221/15 |

(Continued)

*Primary Examiner* — Hoi Lau

(74) *Attorney, Agent, or Firm* — Saile Ackerman LLC; Stephen B. Ackerman

(57) ABSTRACT

A medication dispenser is described. A plurality of drawers capable of storing medications is arranged in an array. For personal use, each drawer has an illuminatable number thereon representing a date in a month. For institutional use, each drawer has an associated adjacent illuminatable patient identification section. Illuminatable numbers in a row above the drawers correspond to hours in a day wherein a current time is displayed by illuminating one of the numbers. Rechargeable batteries maintain a memory capable of storing information about when each of a plurality of medications is to be taken. When the current time matches a time when one of the medications is to be taken, a number on the drawer corresponding to a current date or the particular patient identification section is illuminated. A sensor senses when a particular drawer is opened and saves in memory the current time and drawer identification.

2 Claims, 6 Drawing Sheets

(56) References Cited

U.S. PATENT DOCUMENTS 5,133,478 A 7/1992 Gordon
5,200,891 A * 4/1993 Kehr ..... A61J 7/0481 221/15
5,408,443 A * 4/1995 Weinberger ..... A61J 7/0481 221/3
5,412,372 A * 5/1995 Parkhurst ..... G06F 19/3462 221/15
5,838,224 A * 11/1998 Andrews ..... A61J 7/0481 221/15
5,852,590 A * 12/1998 de la Huerga ..... A61J 7/0481 368/10
6,018,289 A * 1/2000 Sekura ..... A61J 7/0481 221/15
6,032,609 A * 3/2000 Luoma ..... G09F 11/23 116/205
6,102,855 A * 8/2000 Kehr ..... A61B 5/0002 206/561
6,163,736 A * 12/2000 Halfacre ..... A61J 7/0481 221/102
6,194,995 B1 * 2/2001 Gates ..... A61J 7/0481 206/531
6,294,999 B1 * 9/2001 Yarin ..... A61J 7/0481 340/573.1
D460,254 S 7/2002 Rufo
6,644,496 B1 11/2003 Ambrosio
7,828,147 B2 * 11/2010 Caracciolo ..... G06F 19/3462 206/530
8,174,370 B1 * 5/2012 Fulmer-Mason ..... A61J 7/04 206/534
8,193,918 B1 * 6/2012 Shavelsky ..... A61J 7/04 340/309.16
8,581,709 B2 * 11/2013 Mazur ..... A61J 7/0481 206/528
8,896,428 B2 * 11/2014 Shalala ..... B65B 7/28 340/309.16
9,211,233 B2 * 12/2015 Shavelsky ..... A61J 7/04
2003/0090364 A1 * 5/2003 Cardinale ..... E05B 43/005 340/5.54
2005/0218152 A1 * 10/2005 Simon ..... A61J 7/0084 221/203
2006/0139150 A1 * 6/2006 Brue ..... A61J 7/0481 340/309.16
2006/0139151 A1 * 6/2006 Rosche ..... A61J 7/0481 340/309.16
2006/0197336 A1 * 9/2006 Londino ..... A61J 7/04 283/81
2006/0271011 A1 * 11/2006 Mock ..... A61M 15/0028 604/500
2007/0261985 A1 * 11/2007 Allen ..... A61J 7/04 206/538
2008/0035520 A1 * 2/2008 Caracciolo ..... G06F 19/3462 206/531
2008/0129496 A1 * 6/2008 Koblasz ..... G08B 21/0261 340/540
2008/0149659 A1 * 6/2008 Dishongh ..... A61J 7/0409 221/3
2009/0294521 A1 * 12/2009 de la Huerga ..... A61J 1/035 235/375
2010/0142330 A1 * 6/2010 Reygaert ..... A61J 7/0481 368/10
2010/0206765 A1 * 8/2010 Fonte ..... A61J 7/04 206/534
2010/0219198 A1 * 9/2010 Goldman ..... B65D 83/0454 221/25
2010/0270257 A1 * 10/2010 Wachman ..... G06Q 10/10 215/228
2010/0314282 A1 * 12/2010 Bowers ..... A61J 1/03 206/534
2011/0057792 A1 * 3/2011 Fralick ..... A61J 7/0481 340/540
2011/0216627 A1 * 9/2011 Ziemba ..... B65D 77/00 368/10
2013/0002795 A1 * 1/2013 Shavelsky ..... A61J 7/04 348/14.01
2013/0030566 A1 * 1/2013 Shavelsky ..... A61J 7/04 700/244
2013/0193030 A1 * 8/2013 Kroupa ..... B65D 21/0204 206/534
2013/0195326 A1 * 8/2013 Bear ..... A61J 7/0076 382/128
2013/0319902 A1 * 12/2013 Tufi ..... A61J 1/035 206/534
2014/0130453 A1 * 5/2014 Shalala ..... B65B 7/28 53/420
2014/0276430 A1 * 9/2014 Baker ..... A61M 5/31566 604/154
2015/0008152 A1 * 1/2015 Xu ..... A61J 1/03 206/538
2016/0008229 A1 * 1/2016 Dickie ..... A61J 1/03 340/309.7
2016/0027163 A1 * 1/2016 Bear ..... G06F 19/3462 348/86
2016/0081881 A1 * 3/2016 Ababio ..... A61J 7/0076 362/23.01

* cited by examiner

TIME AND TEMPERATURE SENSOR MEDICATION DISPENSER FOR HOSPITALS AND NURSING HOMES/MONTHLY PERSONAL TIME

BRIEF DESCRIPTION OF THE DRAWINGS

In the accompanying drawings forming a material part of this description, there is shown.

DETAILED DESCRIPTION

An error free medication dispenser for assisted-living and personal use is disclosed. The medication dispenser keeps a record of all medications and injectables taken by a patient. It records the time and day the medications are taken. Missing of medications is prevented by notification of when a medication is due to be taken. A temperature sensor and regulator in the dispenser helps to ensure the medications' stability. The dispenser is affordable, durable, and energy-efficient with rechargeable batteries. Since the dispenser runs on batteries and is of a compact size, it is portable enough to bring to a patient's doctor's office or on vacation.

Especially when used in a hospital or nursing home setting, the dispenser prevents waste of medication, contamination by mixing liquid and nonliquid medications. There is easy access to replace unused medications into storage. A removable tray can fit into a drawer in the dispenser that will prevent needle sticks and will allow easy transfer of the medication for a patient transfer or discharge. A safety lock is included for accountability.

Figure 1:
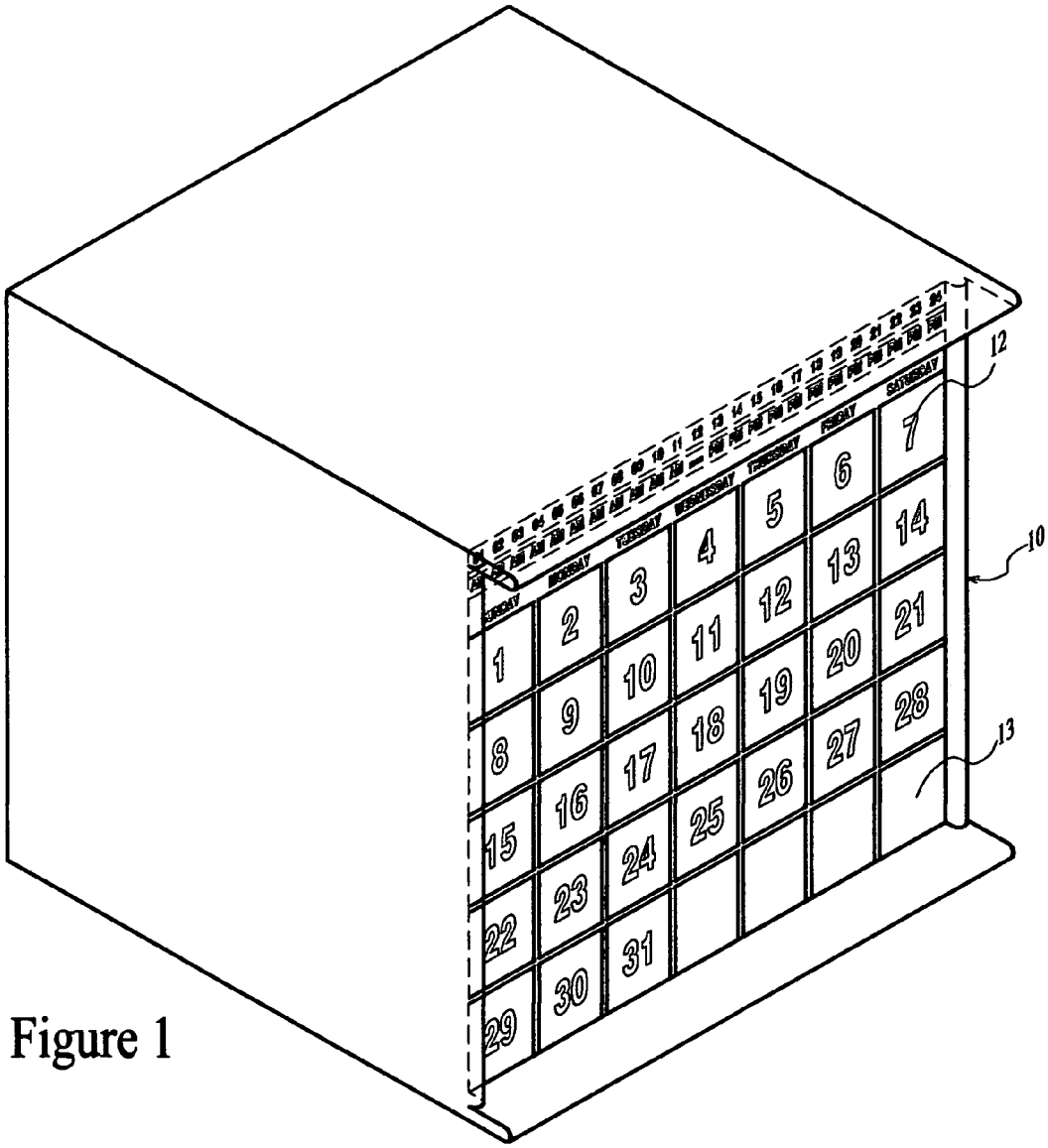
FIG. 1 illustrates a perspective view of a first preferred embodiment of the present disclosure.
Figure 2A:
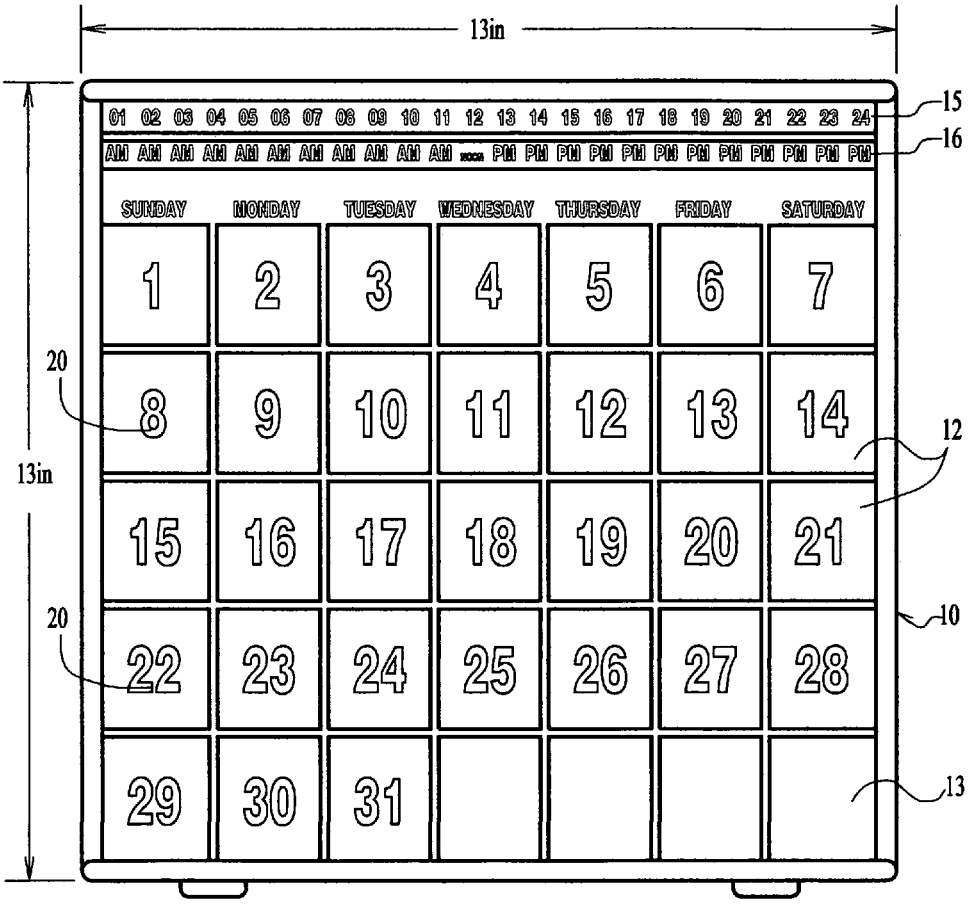
FIG. 2A illustrates a front view of a first preferred embodiment of the present disclosure.
Figure 2B:
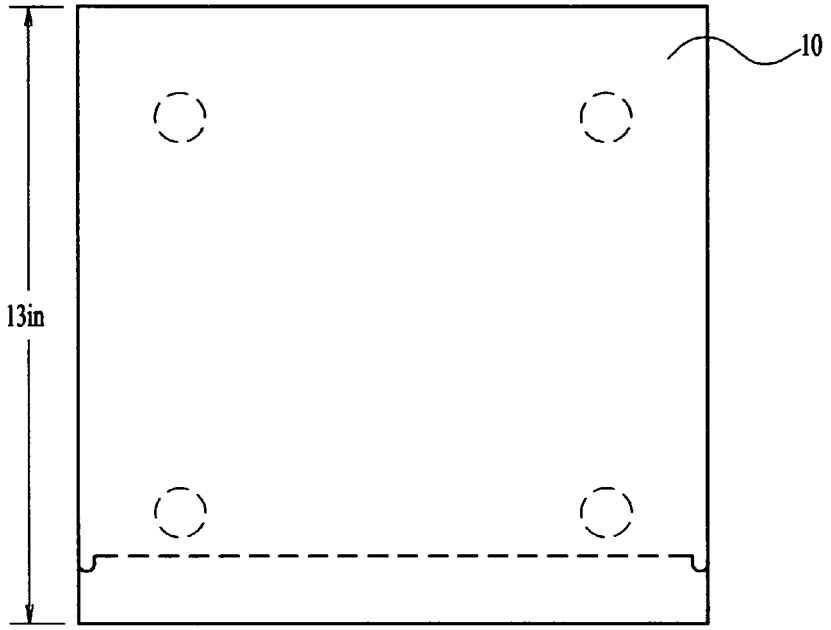
FIG. 2B illustrates a top view of a first preferred embodiment of the present disclosure.

Referring now to the drawing figures, the medication dispenser of the present disclosure will be described in detail. A first preferred embodiment of the disclosure is a medication dispenser for personal use, as shown in FIG. 1. The medication dispenser 10 is a compact, portable size. For example, as shown in FIGS. 2A and 2B, the dispenser could be in the shape of a 13-inch cube.

Figure 2C:
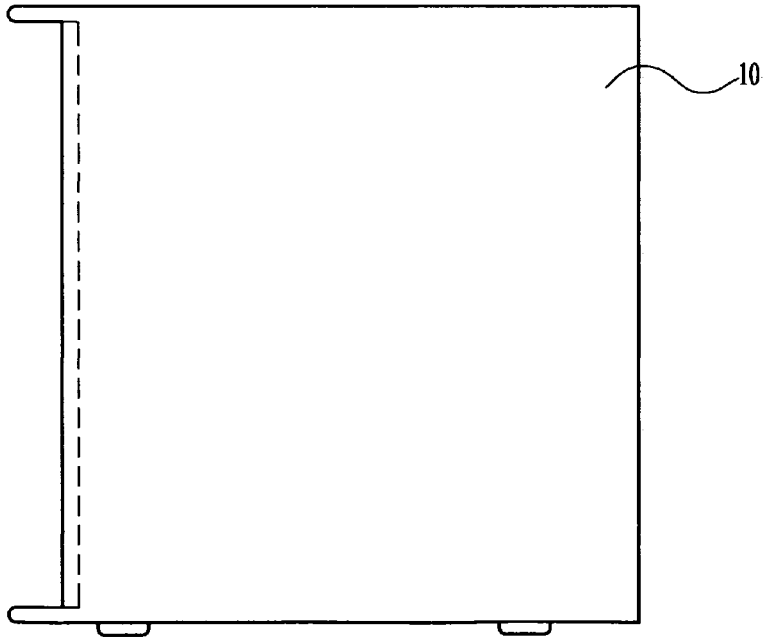
FIG. 2C illustrates a side view of a first preferred embodiment of the present disclosure.

As shown in FIG. 1, the medication dispenser is in the form of a small cabinet containing an array of drawers. Each drawer 12 is inscribed with a number from 1 to 31, arranged in rows of seven. Drawers 13 have no numbers on them, but are extra drawers to fill out the bottom row of seven. Along the top of the cabinet 10 are numbers 1 through 24 in row 15 and indicators for AM, noon, and PM in row 16. These numbers will indicate the time of day in either a 12-hour clock mode using numbers 1-12 in row 15 and AM/PM in row 16 or 24-hour clock mode using all the numbers in row 15. FIG. 2A shows a front view of the cabinet, FIGS. 2B shows a top view, and FIG. 2C shows a side view.

In preparing the medication dispenser cabinet for use, a patient will put all needed medications in the drawers 12 corresponding to each date of the month. Any extra medication that is not to be taken on a daily schedule can be put into the extra drawers 13. The patient will input information about each medication into the medication dispenser cabinet's memory, including setting indicators of when the medication is to be taken at particular times on particular days. Rechargeable batteries maintain this memory.

The current time of day is shown at the top of the cabinet by illumination of the numbers 15 corresponding to the current time, using AM/PM in row 16 if 12-hour clock time has been selected. When it is time for a particular medication to be taken, the numbers 20 on the drawer corresponding to the current date are illuminated. When a patient opens the drawer to take the medication, a sensor in the cabinet recognizes that the drawer has been opened and records the date and time. A temperature sensor in the cabinet ensures the medications' stability.

Figure 3:
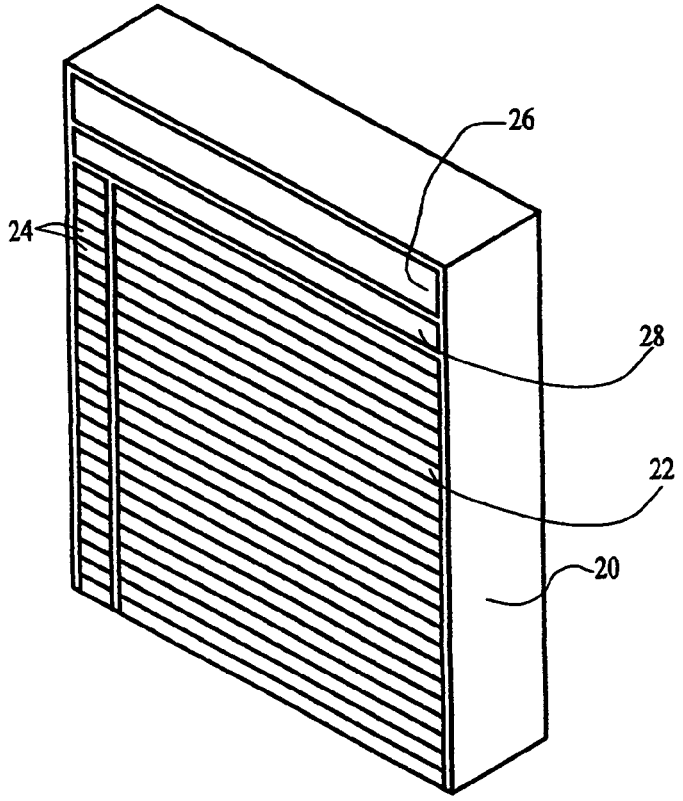
FIG. 3 illustrates a perspective view of a second preferred embodiment of the present disclosure.
Figure 4A:
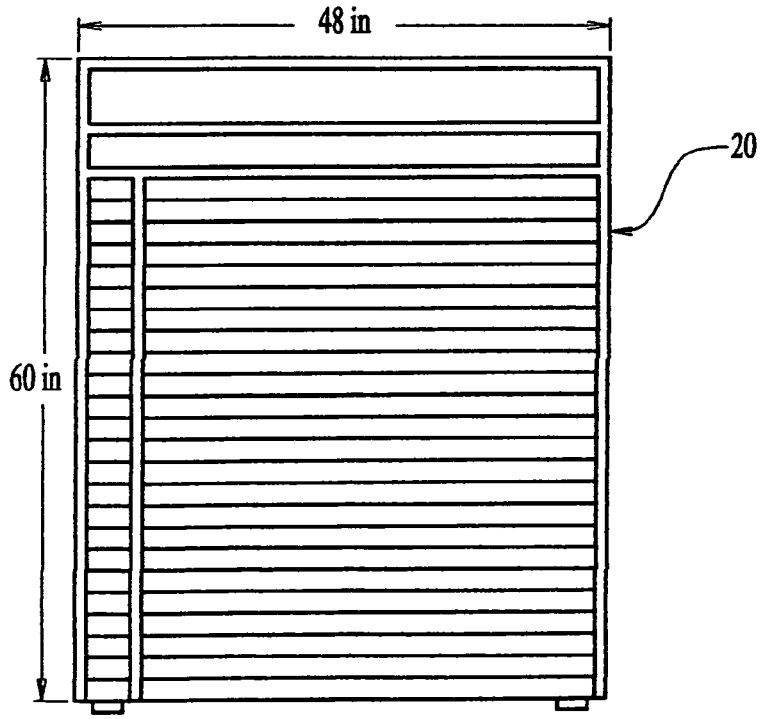
FIG. 4A illustrates a front view of a second preferred embodiment of the present disclosure.
Figure 4B:
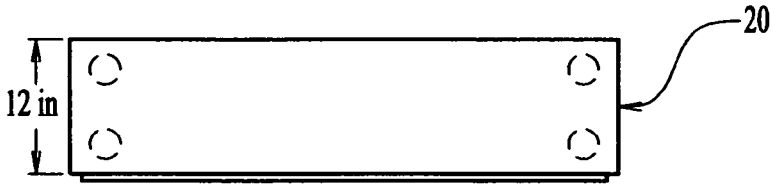
FIG. 4B illustrates a top view of a second preferred embodiment of the present disclosure.

A second preferred embodiment of the disclosure is a medication dispenser for assisted living use, as shown in FIG. 3. The medication dispenser 20 is a portable size. For example, as shown in FIGS. 4A and 4B, the dispenser could be 60 inches tall, 48 inches wide, and 12 inches deep.

Figure 4C:
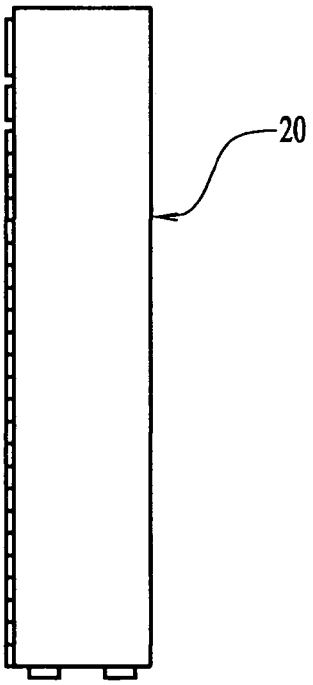
FIG. 4C illustrates a side view of a second preferred embodiment of the present disclosure.
Figure 4D:
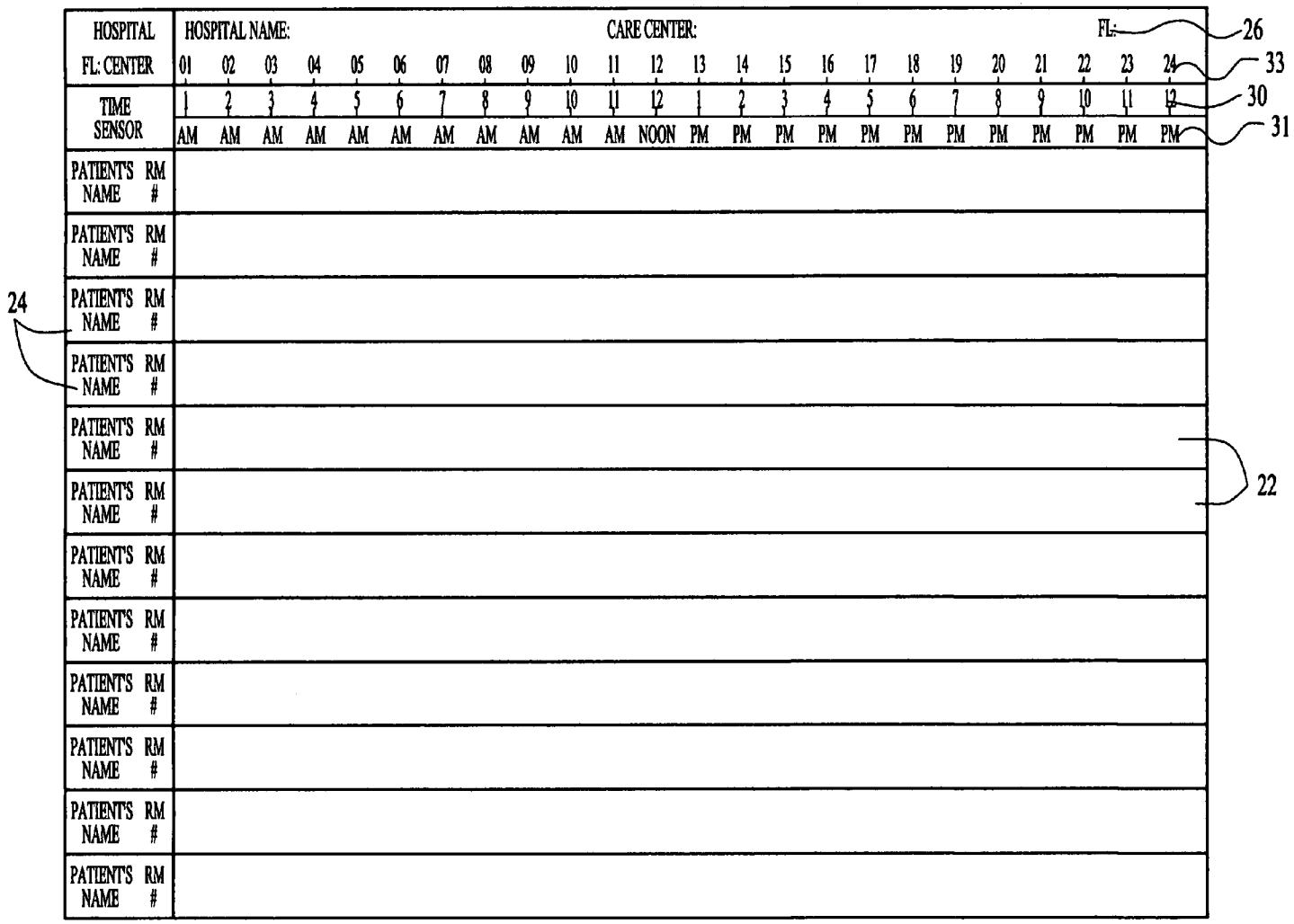
FIG. 4D illustrates a close-up front view of a second preferred embodiment of the present disclosure.

As shown in FIG. 3 and in close-up in FIG. 4D, the medication dispenser is in the form of a cabinet containing a vertical column of drawers. Each drawer 22 is associated with an adjacent patient identification section 24. Information such as the patient's name and room number can be entered into the patient identification section 24, as shown in FIG. 4D. Along the top of the cabinet 20 is a section 26 where information is entered about the hospital or assisted living facility using the cabinet, as shown in FIG. 4D. A second top section 28 below section 26 is used for time sensor information. As shown in FIG. 4D, numbers 1 through 24 in row 33 are used for 24-hour clock mode. Numbers 1-12 and 1-12 in row 30 and indicators for AM, noon, and PM in row 31 will indicate the time of day in 12-hour clock mode. FIG. 4A shows a front view of the cabinet, FIGS. 4B shows a top view, and FIG. 4C shows a side view.

In preparing the medication dispenser cabinet 20 for use, a caregiver will put all needed medications and/or IV medications in the drawers 22 needed for each patient for the entire day. The caregiver will input information about each medication into the medication dispenser cabinet's memory, including setting indicators of when the medications are to be taken at particular times of the day. Rechargeable batteries maintain this memory.

The current time of day is shown at the top of the cabinet by illumination of the numbers 33 or 30 corresponding to the current time, using AM/PM in row 31 if 12-hour clock time has been selected. When it is time for a particular patient to take a medication, the patient identification section 24 is illuminated for that patient. When the caregiver opens the drawer 22 associated with the patient identified to administer the medication, a sensor in the cabinet recognizes that the drawer has been opened and records the date and time. A temperature sensor in the cabinet ensures the medications' stability.

What is claimed is:

1. A medication dispenser for personal use comprising:

a plurality of drawers arranged in a two-dimensional array, each drawer having an illuminatable number thereon representing a date in a month, wherein each drawer is capable of storing medication to be taken on a particular date corresponding to said number on said drawer;

illuminatable numbers in a row above said array of drawers wherein said numbers correspond to hours in a day wherein a current time is displayed by illuminating one of said numbers;

rechargeable batteries for maintaining a memory capable of storing information about when each of a plurality of medications is to be taken;

a temperature sensor for ensuring stability of said plurality of medications; and a sensor capable of sensing when a particular drawer is opened wherein when said current time matches a time when one of said medications is to be taken, a number on said drawer corresponding to a current date is illuminated, and wherein when said drawer is opened, said sensor causes said drawer number and said current time to be saved in said memory, indicating that a medication was taken at said current date and said current time.

2. A medication dispenser for institutional use comprising:

a plurality of drawers arranged in a vertical array, each drawer having an associated adjacent illuminatable patient identification section, wherein each drawer is capable of storing medication to be taken by a patient identified by said patient identification section;

illuminatable numbers in a row above said array of drawers wherein said numbers correspond to hours in a day wherein a current time is displayed by illuminating one of said numbers;

rechargeable batteries for maintaining a memory capable of storing information about when each of a plurality of medications is to be taken by each of a plurality of patients;

a temperature sensor for ensuring stability of said plurality of medications; and a sensor capable of sensing when a particular drawer is opened wherein when said current time matches a time when one of said medications is to be taken by a patient, said patient identification section associated with said patient is illuminated, and wherein when said drawer adjacent to said illuminated patient identification section is opened, said sensor causes information in said patient identification section adjacent to said drawer and said current time to be saved in said memory, indicating that a medication was taken by said patient at said current time.

* * * * *